US005659846A

United States Patent [19]

Yoshioka

[11] Patent Number: 5,659,846

[45] Date of Patent: Aug. 19, 1997

[54] IMAGE FORMING APPARATUS WITH IMPROVED TWO-SIDED COPYING

[75] Inventor: Yoshiki Yoshioka, Osaka, Japan

[73] Assignee: Mita Industrial Co., Ltd., Osaka, Japan

[21] Appl. No.: 595,914

[22] Filed: Feb. 6, 1996

[30] Foreign Application Priority Data

Mar. 6, 1995 [JP] Japan ..... 7-045985

[51] Int. Cl.[6] ..... G03G 15/00

[52] U.S. Cl. ..... 399/85; 399/364; 399/402

[58] Field of Search ..... 355/206, 309, 355/313, 316, 319, 85, 364, 401, 402, 367

[56] References Cited

U.S. PATENT DOCUMENTS 5,323,212 6/1994 Fukui ..... 355/206
5,347,351 9/1994 Morita et al. ..... 355/313

FOREIGN PATENT DOCUMENTS 62-66273 3/1987 Japan ..... 355/319
1-282568 11/1989 Japan ..... 355/319
3-237473 10/1991 Japan ..... 355/319

*Primary Examiner*—Joan H. Pendegrass
*Attorney, Agent, or Firm*—Rabin, Champagne & Lynt, P.C.

[57] ABSTRACT

The image forming apparatus of the present invention performs image forming operations for each predetermined number of sheets, giving an operator required directives of replacing document originals at required timing when, in a two-side image forming mode, a set number of copy sheets is judged to be over the storing capacity of an intermediate tray. Given such proper directives, the operator can conduct the image forming operation on a large volume of copy sheets without making mistakes in a complicated procedure of setting document originals.

4 Claims, 9 Drawing Sheets

IMAGE FORMING APPARATUS WITH IMPROVED TWO-SIDED COPYING

BACKGROUND OF THE INVENTION

The present invention generally relates to an image forming apparatus such as a copying machine, and more particularly to an image forming apparatus employing an intermediate tray to form images on both sides of a copy sheet.

Conventionally, there have been widely used copying machines which are adapted to optically scan an image of a document original placed at an image forming position on a contact glass; to form an electrostatic latent image corresponding to the image of the document original thus scanned on a photoconductive material; to develop the electrostatic latent image into a toner image; and then to transfer the resultant toner image onto a copy sheet. Such copying machines typically allow the selection of image forming modes which include: (a) one-side copy modes such as mode wherein an image of a one-sided document original is reproduced on one side Of a copy sheet, and a mode wherein images of a two-sided document original are reproduced on one side of each copy sheet; and (b) two-side copy modes such as mode wherein images of one-sided document originals are reproduced on both sides of a copy sheet respectively, and a mode wherein images of a two-sided document original are reproduced on both sides of a copy sheet.

In the two-side copy mode of (b), after an image is reproduced on one side of a copy sheet, another image must be reproduced on the other side of the copy sheet, and therefore, copy sheet with an image reproduced on one side thereof is stored by an intermediate tray within the main body of a copying machine, from which the copy sheet thus stored is taken out so that another image may be reproduced on the other side thereof.

Unfortunately, the copying machine is restricted in the number of sheets to be stored by the intermediate tray, which determines the number of copy sheets to have images formed on both sides thereof in the two-side copy mode.

For example, if 120 two-sided copies are to be produced from one document original by the use of an intermediate tray having the capacity of storing 100 sheets, it is impossible to produce all the 120 copies at a time because the intermediate tray cannot receive as many as 120 sheets.

In this case, the prior art machines are arranged such that the keyboard for setting the number of copies to be produced does not permit the setting of the number of copies which exceeds the storing capacity of the intermediate tray.

Consequently, it was impossible to produce a large volume of two-sided copies at a time.

SUMMARY OF THE INVENTION

It is an objective of the present invention to provide an image forming apparatus eliminating the limitation in reproduction due to the limited capacity of the intermediate tray thereby permitting the production of a large volume of two-sided copies at a time.

An image forming apparatus according to the present invention for achieving the above objective comprises: image forming mode specifying means for setting a two-side image forming mode to effect image forming operations on both sides of a copy sheet by the use of an intermediate tray; sheet number setting means for setting the number of copy sheets to be subject to the image forming operations with respect to the same document original; image forming operation repeating means for performing the image forming operations for each predetermined number of copy sheets when it is judged, in the two-side image forming mode as set by the image forming mode specifying means, that the number of copy sheets set by the sheet number setting means exceeds the storing capacity of the intermediate tray; and document original replacement directive means for giving an operator a required directive of replacing a document original when the image forming operations are effected by the image forming operation repeating means (first aspect of the invention).

In the foregoing image forming apparatus, when it is judged, in the two-side image forming mode, that the number of copy sheets thus set exceeds the storing capacity of the intermediate tray, the image forming operations are performed for each predetermined number of copy sheets. The reason for dividing the number of copy sheets by a predetermined number is because one round of the image forming operations cannot cover the number of copy sheets that exceeds the storing capacity of the intermediate tray.

If rounds of the image forming operations are repeated in this manner, a directive of replacing a document original should be given to the operator at a required timing. Examples of such directives may include "Replace the document original with the next one", "Replace the document original with the previous one", and "Turn over the document original". As instructed by such appropriate directives, the operator can obtain an image on a great volume of copy sheets without making mistakes. Accordingly, errors which may occur in the image forming process may be prevented thereby making it possible to avoid waste of resources.

An image forming apparatus according to the present invention, which performs image forming operations for forming, on a copy sheet, an image of a document original fed to an image forming position by automatic document original feeding means, comprises: image forming mode specifying means for setting a two-side image forming mode to effect the image forming operations on both sides of a copy sheet by the use of an intermediate tray; sheet number setting means for setting the number of copy sheets to be subject to the image forming operations with respect to the same document original; and image forming operation repeating means for performing the image forming operations for each predetermined number of copy sheets when it is judged, in the two-side image forming mode as set by the image forming mode specifying means, that the number of copy sheets set by the sheet number setting means exceeds the storing capacity of the intermediate tray (second aspect of the invention).

In the foregoing image forming apparatus, when it is judged, in the two-side image forming mode, that the number of copy sheets thus set exceeds the storing capacity of the intermediate tray, the image forming operations are performed for each predetermined number of copy sheets using the automatic document original feeding means. In this case, the use of the automatic document original feeding means allows document originals to be replaced automatically, thereby eliminating the need for the operator to replace a document original each time.

Particularly, when rounds of the image forming operations are repeated, the automatic document original feeding means is used to automatically feed document originals in a predetermined order so that the operator need not set individual document originals by hand, and thus can avoid setting errors.

An image forming apparatus according to the present invention having the second aspect thereof is capable of forming on a copy sheet both image of a document original fed to the image forming position by the aforementioned automatic document original feeding means and that of a document original fed directly thereto not by the automatic document original feeding means, and further comprises sheet number limiting means for limiting the number of copy sheets to be set by the sheet number setting means to the storing capacity of the intermediate tray when an image of a document original fed directly to the image forming position not by the automatic document original feeding means is to be formed on the number of copy sheets set by the sheet number setting means, which number is judged to be over the storing capacity of the intermediate tray (third aspect of the invention).

According to the foregoing arrangement, when an image of a document original fed directly to the image forming position not by the automatic document original feeding means (manually fed document original) is to be formed on a set number of copy sheets, which number is judged to be over the storing capacity of the intermediate tray, the set number of copy sheets is limited to the number that can be stored by the intermediate tray. Thus, when a manually fed document original is reproduced, the number of copy sheets to be subject to the image forming operations is limited so that the operator may realize that it is impossible to reproduce it on such a great volume of copy sheets. Consequently, the operator has to use the automatic document original feeding means which leads to the avoidance of setting errors that could occur when the image forming operations are repeated by manually feeding document originals and thus, the operator may be saved unwanted trouble.

An image forming apparatus according to the present invention having the second aspect thereof is capable of forming on a copy sheet both image of a document original fed to the image forming position by the automatic document original feeding means and that of a document original fed directly thereto not by the automatic document original feeding means, and further comprises prohibition means for prohibiting the forming of an image of a document original fed directly to the image forming position not by the automatic document original feeding means when it is judged that the number of copy sheets set by the sheet number setting means exceeds the storing capacity of the intermediate tray (fourth aspect of the invention).

According to the fourth aspect of the invention, the image forming operations are prohibited if an image of a document original fed directly to the image forming position not by the automatic document original feeding means (manually fed document original) is to be formed on the number of copy sheets set by the sheet number setting means, which number is judged to be over the storing capacity of the intermediate tray. Thus, the operator trying to reproduce manually fed document originals judges that he/she should use the automatic document original feeding means instead, whereby avoiding setting errors that could occur when the image forming operations are repeated by manually feeding document originals. This may save the operator unwanted trouble.

An image forming apparatus according t the present invention having the first or second aspect thereof further comprises cancel means for canceling the image forming operations for forming images on both sides of a copy sheet as effected by the image forming mode specifying means when there is one document original to be reproduced in a mode to form images of one-sided document originals on both sides of a copy sheet as effected by the image forming mode specifying means (fifth or sixth aspect of the invention).

According to the foregoing arrangement, when there is one document original to be reproduced in the mode to reproduce one-sided document originals on both sides of a copy sheet as effected by the image forming mode specifying means, the image forming operations for forming images on both sides of a copy sheet as effected by the image forming mode specifying means can be canceled so that the image forming operations may be performed on one side of a copy sheet without using the intermediate tray. This results in faster image forming process with an unnecessary image forming step on the back side of a copy sheet omitted.

The foregoing and other objects of the present invention will be apparent from the following description taken if connection with the accompanying drawing.

BRIEF DESCRIPTION OF THE DRAWING

FIG. 3A shows a normal presentation while FIG. 3B shows a mode setting presentation for selecting a mode from two-side/two-side copy mode, book-page/two-side copy mode and one-side/two-side copy mode.

FIG. 7A shows a display representing a message saying, "Reproduction completed. Set the next document original and press Print Key." which appears upon completion of production of a unit number of copies of a first one-sided document original. FIG. 7B shows a display representing a message saying, "Set the previous document original and press Print Key." which appears upon completion of reproduction of a second document original.

FIG. 8A shows a display representing a message saying, "Turn over the document original and press Print Key." which appears upon completion of production of a unit number of copies of either the front side or the back side of a two-sided document original. FIG. 8B shows a display representing a message saying, "Reproduction completed. Set the next document original and press Print Key." which appears upon completion of production of the preset number of copies.

DETAILED DESCRIPTION OF THE EMBODIMENT

Figure 1:
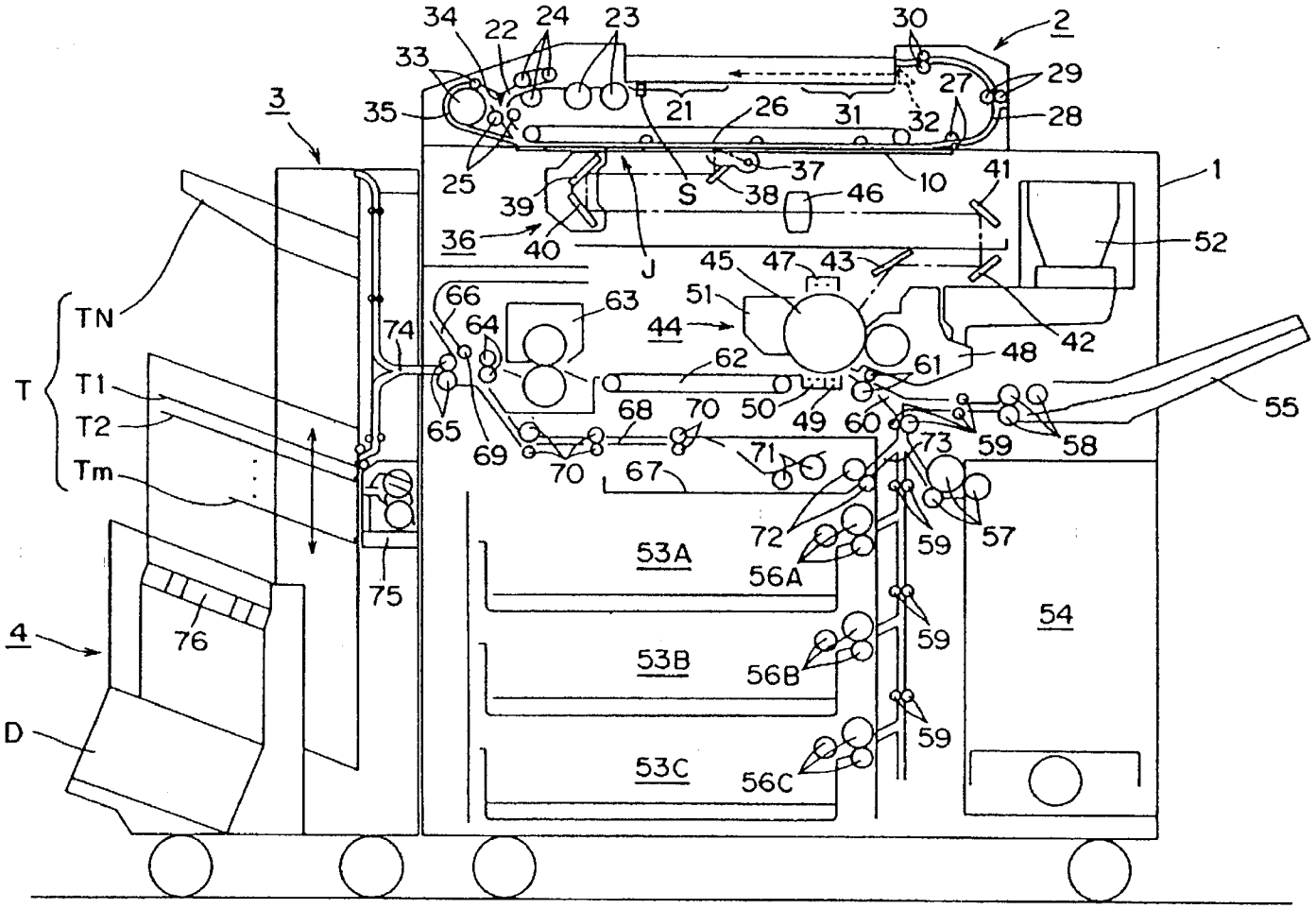
FIG. 1 is a schematic view illustrating an example of the arrangement of a copying machine incorporating an image forming apparatus of the present invention.

FIG. 1 is a schematic view illustrating an example of the arrangement of a copying machine incorporating an image forming apparatus of the present invention. The copying machine comprises a main body 1 of the copying machine, Reversible Document Holder 2 (hereinafter referred to as RDH) mounted atop the main body 1 and capable of automatically circulating document originals for reuse, a sorter 3 for sorting copy sheets exiting from the main body 1 to sortably discharge them into any one of plural bins TN, T1, T2, . . . Tm (hereinafter referred to generally as "bin T"), and a stacker 4 for collecting copy sheets discharged in the bin T to stack them in a stacking section D.

A transparent platen 10 is disposed on the top surface of the main body 1 of the copying machine. If a document original to be reproduced is one-sided, it should be placed at an image forming position (position exposed to light) J on the platen 10 with the front side thereof turned downward, whereas if a document original to be reproduced is two-sided, it should be placed at the image forming position J with either of the sides thereof turned downward.

RDH 2 automatically feeds document originals to the image forming position J on the platen 10. RDH 2 is provided to alleviate the cumbersome and inefficient procedure of constantly repositioning document originals each time a document original is reproduced.

RDH 2 comprises a document original detection sensor S for detecting document originals set at a document original setting position 21, a sheet feeding roller 23 and a primary sheet feeding roller 24 for taking out the document originals one by one from the bottom sheet and feeding it into a sheet feeding passage 22 continuous to the platen 10 during a primary sheet feeding process, and a secondary sheet feeding roller 25 and a transport belt 26 for further advancing the document original thus fed to the image forming position J on the platen 10 during a secondary sheet feeding process. A document original on the platen 10 is transported by the transport belt 26. A document original which has been reproduced is guided by a primary sheet discharge roller 27 into a sheet exit passage 28 to be discharged through a relay roller 29 and a secondary sheet discharge roller 30 to a document original exit position 31. When all the document originals set at the document original setting position 21 are discharged, the document originals are all set at the document original setting position 21 automatically by a document original feed plate 32.

RDH 2 further comprises a reverse roller 33 which, in a mode to reproduce a two-sided document original on both sides of a copy sheet (hereinafter referred to as "two-side/two-side copy mode"), reverses a two-sided document original, one side of which has been reproduced, for feeding the same to the image forming position J. A two-sided document original, one side of which has been reproduced, is returned by the transport belt 26 to the sheet feeding passage 22 where the secondary sheet feeding roller 25 is reversed while a separator claw 34 closes the sheet feeding passage 22 side so that the document original is guided into a reverse passage 35. The two-sided document original guided into the reverse passage 35 is advanced therethrough by the rotation of the reverse roller 33 to the image forming position J.

According to the arrangement of RDH 2, a document original is normally placed at the document original setting position 21 with the front side thereof turned upward so that a document original to be fed to the image forming position J is always fed thereto with the front side thereof turned downward, and after reversed, is fed thereto with the back side thereof turned downward.

The main body 1 of the copying machine includes therein a document original reading section 36 in association with the platen 10. The document original reading section 36 comprises a light source 37 for scanning as illuminating a document original placed at the image forming position J on the platen 10. The light source 37 is caused to reciprocate along the platen 10 laterally in FIG. 1 as driven by a motor of the optical system not shown in the figure. Light rays from the light source 37 are reflected by the document original placed at the image forming position J. The light rays reflected from the document original are reflected by a first reflecting mirror 38 driven in unison with the light source 37, and by a second reflecting mirror 39, a third reflecting mirror 40, a fourth reflecting mirror 41, a fifth reflecting mirror 42, and a sixth reflecting mirror 43, so as to be guided onto a photoconductive drum 45 provided at an image forming section 44. The second reflecting mirror 39 and the third reflecting mirror 40 are caused to move laterally in FIG. 1 at a half speed of the speed that the light source 37 is caused to move, whereby the length of optical path from the light source 37 to the photoconductive drum 45 is maintained constant throughout the process of scanning of the document original with the light rays from the light source 37. Disposed between the third reflecting mirror 40 and the fourth reflecting mirror 41 is a zoom lens 46 for focusing an image of the document original on the photoconductive drum 45.

The image forming section 44 includes the aforesaid photoconductive drum 45 driven to rotate at a given speed during the production of copies, as well as a main corona charger 47, a developing unit 48, an image transfer charger 49, a sheet separation charger 50 and a cleaning unit 51 which are disposed in the periphery of the photoconductive drum 45 sequentially along the direction of the rotation thereof.

After uniformly charged by the main corona charger 47, the surface of the photoconductive drum 45 is exposed to light rays reflected from a document original. As a result, an electrostatic latent image corresponding to an inverted image of the document original is formed on the surface of the photoconductive drum 45. In the developing unit 48, the electrostatic latent image is developed into a toner image by toner powder fed by a toner hopper 52. The toner image is transferred onto a copy sheet by the image transfer charger 49. After the toner image is transferred from the surface of the photoconductive drum 45, the toner powder remaining thereon is removed by the cleaning unit 51. The sheet separation charger 50 separates a copy sheet from the surface of the photoconductive drum 45. The main corona charger 47, the image transfer charger 49 and the sheet separation charger 50 effect their respective functions by causing corona discharge.

Hereinafter, a series of operations including exposure to light from the light source 37, driving of elements such as the light source 37, charging by the main corona charger 47, driving/rotation of the photoconductive drum 45, development of an image by the developing unit 48, image transfer by the image transfer charger 49, and sheet separation by the sheet separation charger 50 will be referred to as "copying operation" and elements involved in this operation will be referred to generally as "copying operation section 97".

In synchronism with the copying operation of the image forming section 44, a copy sheet is fed from any one of an upper deck 53A, a middle deck 53B, a lower deck 53C, a bulk deck 54 and a manual feed tray 55 (hereinafter referred to generally as "upper deck 53A and the like"). The upper deck 53A, the middle deck 53B and the lower deck 53C accommodate copy sheets of different sizes respectively. The bulk deck 54 accommodates a great volume of copy sheet of a size different from those contained in the upper deck 53A, the middle deck 53B and the lower deck 53C which are used particularly frequently. The manual feed tray 55 accommodates copy sheets having a predetermined format, cover sheets such as made of thick paper, or inter sheets such as made of colored paper.

Paper take-out rolls 56A, 56B, 56C, 57 and 58 for taking out one copy sheet at a time are provided in association with the upper deck 53A, the middle deck 53B, the lower deck 53C, the bulk deck 54 and the manual feed tray 55 respectively. During the production of copies, any one of the paper take-out rolls 56A, 56B, 56C, 57 and 58 is driven to rotate thereby guiding copy sheets from any one of the upper deck 53A, the middle deck 53B, the lower deck 53C, the bulk deck 54 and the manual feed tray 55 through a relay roller 59 into a sheet transport passage 60 which extends to the vicinity of the photoconductive drum 45.

A pair of resist rollers 61 are provided in the sheet transport passage 60 close to the photoconductive drum 45. The resist rollers 61 temporarily halt a copy sheet and thereafter, feeds it to the photoconductive drum 45 as synchronized with the rotation of the photoconductive drum 45. Thus, the copy sheet is fed to the photoconductive drum 45 so synchronized as to be overlapped with a toner image on the surface of the photoconductive drum 45 at the image transfer charger 49. An operation for feeding a sheet from the resist rollers 61 to the photoconductive referred to be hereinafter referred to as "copy sheet feeding operation", and elements involved in the operation will be referred to generally as "copy sheet feeding section 98".

A copy sheet having a toner image transferred thereon by the image transfer charger 49 is separated from the surface of the photoconductive drum 45 by the sheet separation charger 50, and then is guided to a fixing unit 63 by a transport belt 62. The fixing unit 63 fixes toner powder on the surface of a copy sheet. After the fixing process, the copy sheet is carried to the sorter 3 by a transport roller 64 and a sheet discharge roller 65.

Branched from a passage between the transport roller 64 and the sheet discharge roller 65 are a reverse passage 66 for reversing a copy sheet after the fixing process and an intermediate passage 68 for transporting a copy sheet to an intermediate tray 67, which is disposed at the central portion of the main body 1.

The intermediate tray 67 is used in effecting a mode wherein one-sided document originals are reproduced on both sides of a copy sheet (hereinafter referred to as "one-side/two-side copy mode"), a mode wherein a book-page document original is reproduced on both sides of a copy sheet (hereinafter referred to as "book-page/two-side copy mode") and a two-side/two-side copy mode.

In the one-side/two-side copy mode, the book-page/two-side copy mode and the two-side/two-side copy mode, copy sheets after the fixing process are first introduced into the reverse passage 66 by a separation claw not shown in the figure and a reverse roller 69, and thereafter, are introduced into the intermediate passage 68 by the reverse rotation of the reverse roller 69 to be stored by the intermediate tray 67. The intermediate passage 68 is provided with transport rollers 70 at proper intervals. During a subsequent copy sheet feeding operation, copy sheets held in the intermediate tray 67 are taken out by sheet feeding rollers 71 and 72 individually at a time to be introduced into a transport passage 73 joining the sheet transport passage 60, and thus are sent again to the photoconductive drum The sorter 3 comprises a plurality of bins T as described above. As discharged by the sheet discharge roller 65, copy sheets are guided into a sheet discharge passage 74 to be sorted into a predetermined bin T by a sorting mechanism not shown in the figure. A bin TN, out of the plural bins T, is a non-sorting bin which is used when copied sheets are discharged without sorting process. When copied sheets are discharged through a sorting process, the other bins T1, T2, . . . , Tm are used as sorting bins.

The sorter 3 is also provided with a punching/stapling unit 75 for performing a punching or stapling process wherein plural copied sheets introduced into any one of the sorting bins T1, T2, . . . , Tm are bound by, for example, a stapler. The sorting bins T1, T1 . . . , Tm are vertically movable. To perform the punching or stapling process, any one of the sorting bins T1, T2, . . . , Tm accommodating copied sheets to be subject to the punching or stapling process is caused to move to a position corresponding to the punching/stapling unit 75. A stacker 4 stacks in a stacking section D copied sheets which have been punched or stapled by the punching/stapling unit 75. The copied sheets which have been punched or stapled are taken out by a take-out unit 76 provided at the stacker 4 so as to be guided into the stacking section D.

Figure 2:
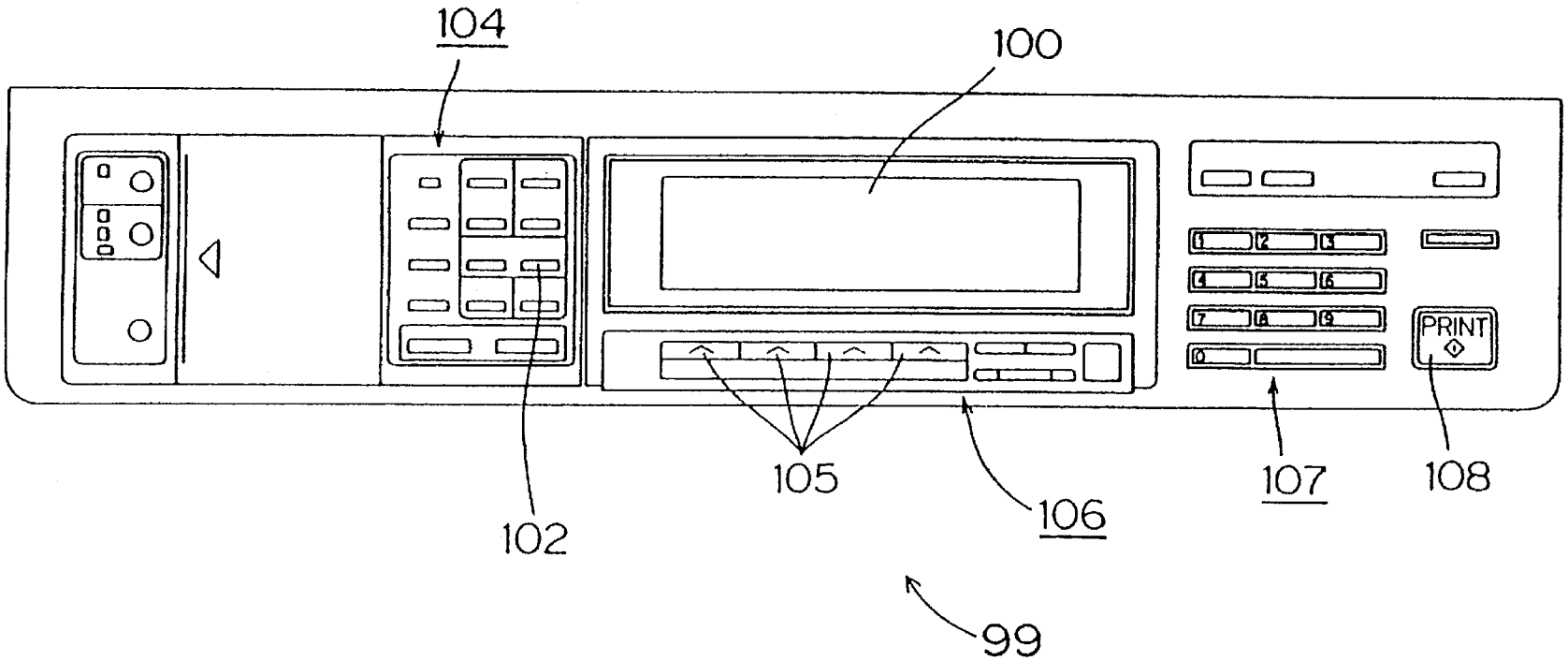
FIG. 2 is a front view illustrating the exterior construction of an operating section provided at the upper front portion of the copying machine.

FIG. 2 is a front view illustrating the external arrangement of an operating section 99 disposed at the upper front portion of the copying machine, which is not shown in FIG. 1.

The operating section 99 has a display 100 at the central part thereof which comprises, for example, a liquid crystal display (LCD). Disposed under the display 100 in FIG. 2 are a plurality of mode setting keys 105 for selecting any one of plural options presented in the display 100. The options in the display 100 are presented at positions corresponding to their respective mode setting keys 105. An option is selected by pressing a mode setting key 105 at a position corresponding to the option to be selected.

A mode select section 104 including a two-side copy mode key 102 for setting the two-side copy mode is disposed at the left side of the display 100 in FIG. 2, while located at the right side of the display 100 in FIG. 2 are ten keys 107 and a print key 108 for giving a directive to start copying.

Figures 3A, 3B:
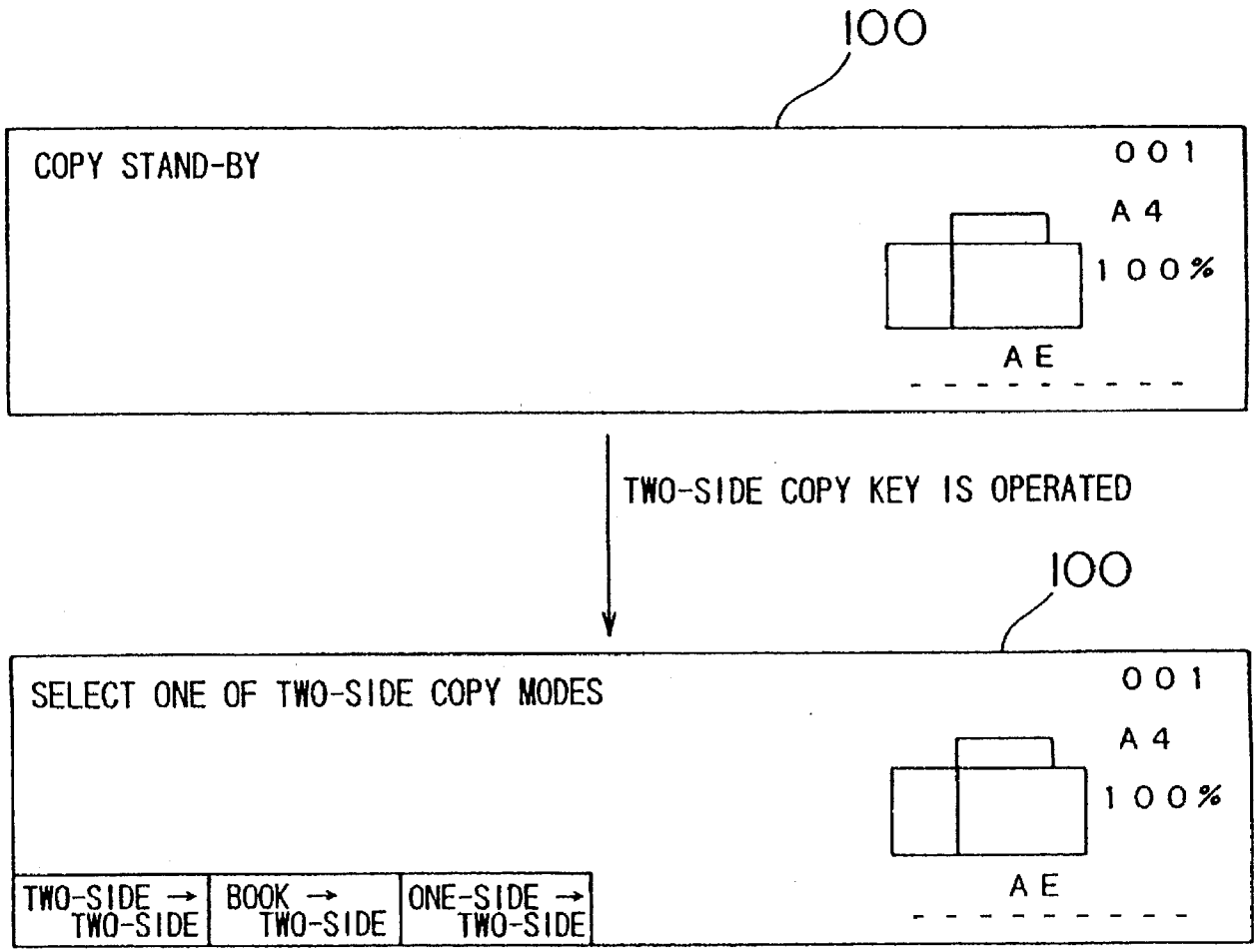
FIGS. 3A and 3B illustrate steps for setting a two-side copy mode in the copying machine.

FIGS. 3A and 3B are diagrams for illustrating operations for setting any one of the modes including one-side/two-side copy mode, book-page/two-side copy mode and two-side/two-side copy mode, showing a flow of presentations in the display 100.

When the operator presses the two-side copy key 102 with a normal copy presentation presented in the display 100 as shown in FIG. 3A, the display 100 is switched to a mode setting presentation as shown in FIG. 3B to allow the selection of any one of the two-side/two-side copy mode, the book-page/two-side copy mode and the one-side/two-side copy mode. A desired mode can be set by selecting a mode setting key 105 which corresponds to one of the two-side copy modes.

Figure 4:
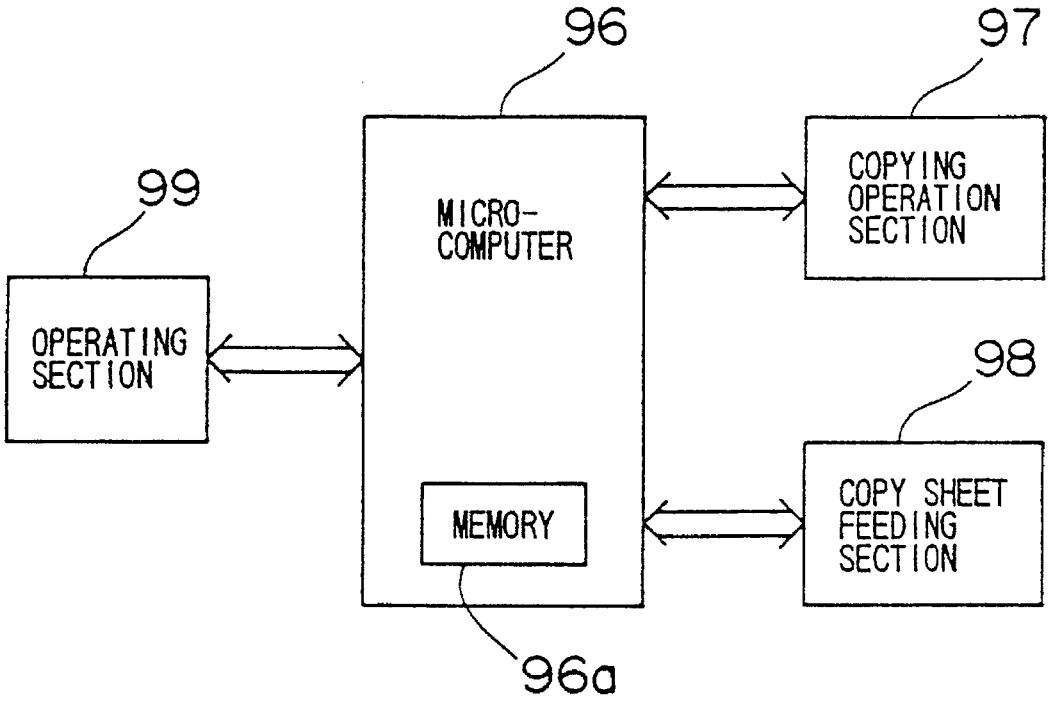
FIG. 4 is a diagram illustrating the electrical arrangement for performing operations of the copying machine according to the embodiment of the present invention.

FIG. 4 is a diagram illustrating the electrical arrangement for performing the operations of the copying machine according to the present embodiment, the central part of which is a microcomputer 96 integrating the functions of the aforesaid copying operation section 97, copy sheet feeding section 98 and operating section 99. The microcomputer 96 is disposed at a predetermined position within the main body 1. It incorporates a memory **96*a*** for executing its program.

Figure 5:
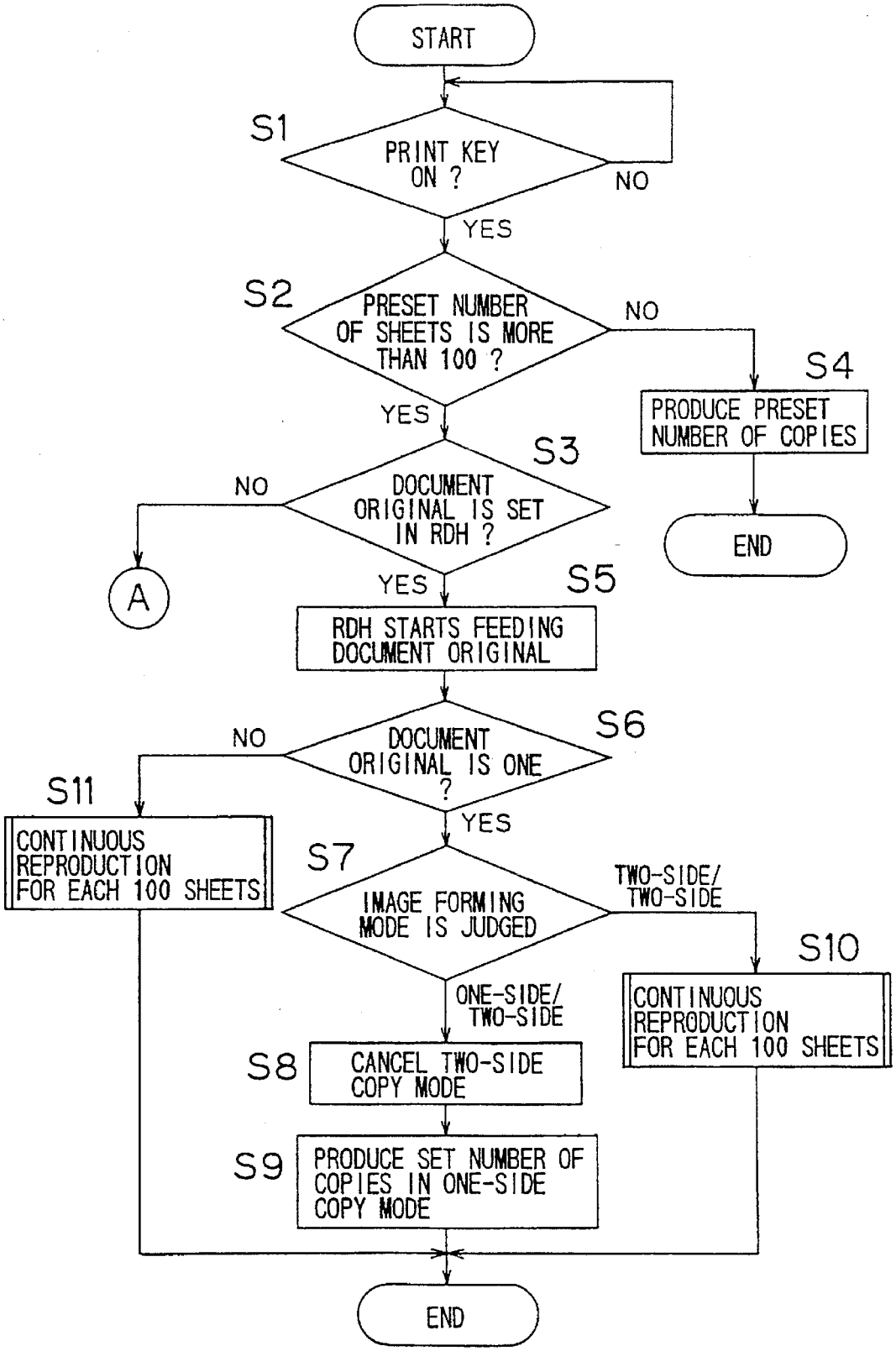
FIG. 5 is a flow chart for illustrating a two-side copying operation of the copying machine according to the embodiment of the present invention.
Figure 6:
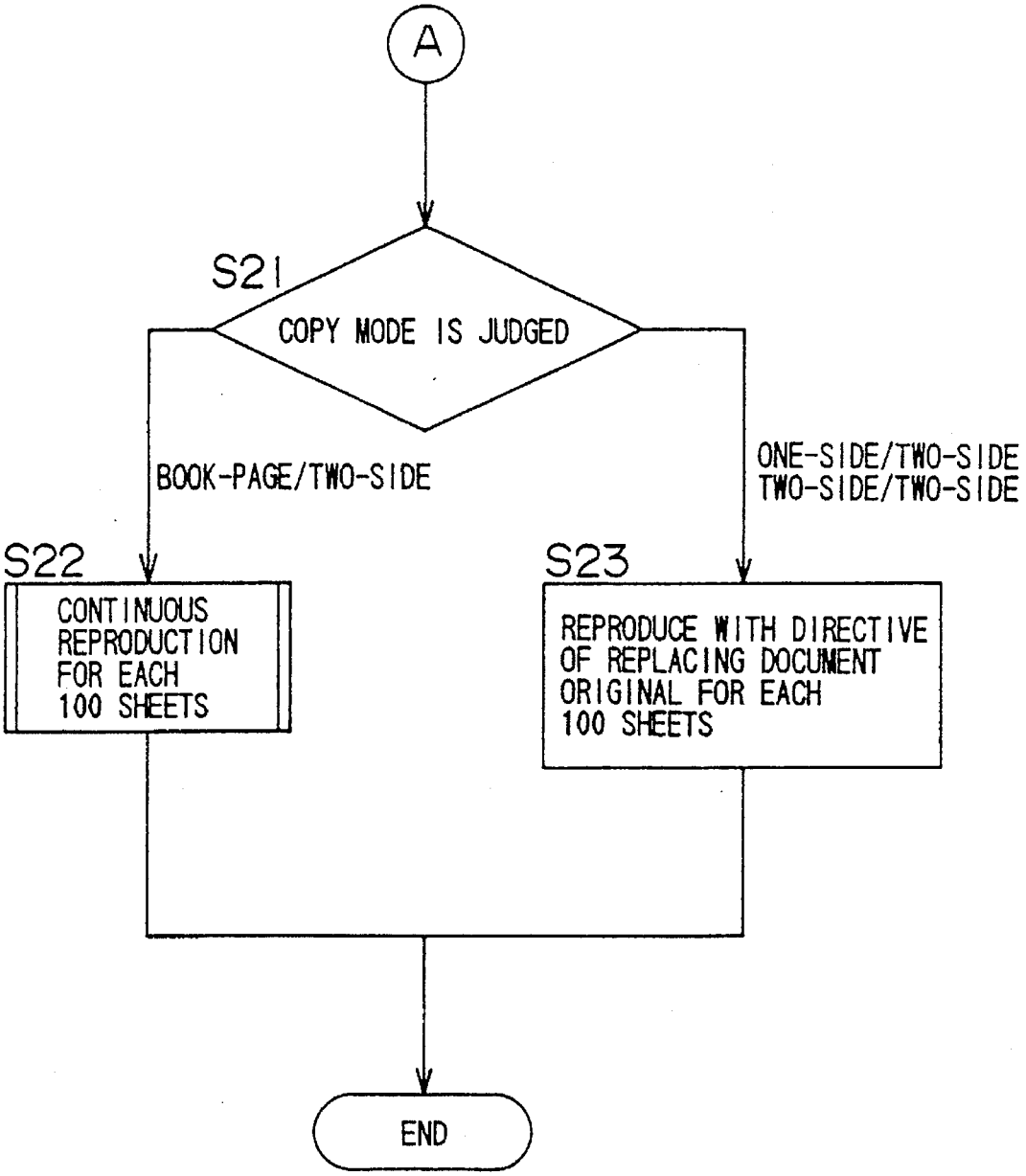
FIG. 6 is a flow chart for illustrating the two-side copying operation of the copying machine according to the embodiment of the invention (continuous of FIG. 5).

FIGS. 5 and 6 are flow charts for illustrating the operations of the copying machine according to the present embodiment. The operations shown by the flow charts are executed by means of the software of the microcomputer.

The flow charts are based on the premises that one of the modes including the two-side/two-side copy mode, book-page/two-side copy mode and two-side/two-side copy mode has been selected as the image forming mode and that the number of copy sheets (referred to as "preset number of sheets") has been set. It is also the premise that the intermediate tray 67 can receive up to 100 copy sheets.

When the print key 108 is pressed (Step S1), a preset number of sheets is checked (Step S2) and if it is not more than 100, the preset number of copies are produced according to the settings (Step S4).

If the preset number of copy sheets is more than 100, whether a document original is set in RDH 2 or not (or manually fed document original) is judged (Step S3). Firstly, a case where the document original is set in RDH 2 will be described as below.

When a document original is fed by RDH 2 (Step S5), whether the number of the document original is one or not is judged (Step S6). The judgment may be made based on whether the document original detection sensor S is turned off or not.

If it is judged that there are more than one document originals, an operation for "continuous reproduction for each 100 sheets" (to be described later) is performed (Step S11).

If there is one document original, judgment is made on which of the two-side/two-side copy mode and the one-side/two-side copy mode is selected (Step S7). The image forming modes in this case does not include the book-page/two-side copy mode because RDH 2 is used.

If the two-side/two-side copy mode is selected, the operation for "continuous reproduction for each 100 sheets" (to be described later) is performed (Step S10).

If the one-side/two-side copy mode is selected, the two-side copy mode is canceled (Step S8) so that the one-side copy mode is selected to produce a set number of copies (Step S9). More specifically, copies of the one-sided document original in this mode are not stored by the intermediate tray 67 but are directly guided into the sheet discharge passage 74, whereby a wasteful process of reproducing an image of the back side of a one-sided document original (normally blank) is omitted.

If the document original is not set in RDH 2, it is judged that the document original is manually fed and the flow proceeds to Step S21 in FIG. 6, where judgment is made on which image forming mode is selected from the book-page/two-side copy mode, the two-side/two-side copy mode and the one-side/two-side copy mode (Step S21). If the book-page/two-side copy mode is selected, the operation for "continuous reproduction for each 100 sheets" (to be described later) is performed (Step S22).

If either the one-side/two-side copy mode or the two-side/two-side copy mode is selected, an operation for "reproduction with a directive of replacing a document original given for each 100 sheets" is performed (Step S23).

Figures 7A, 7B:
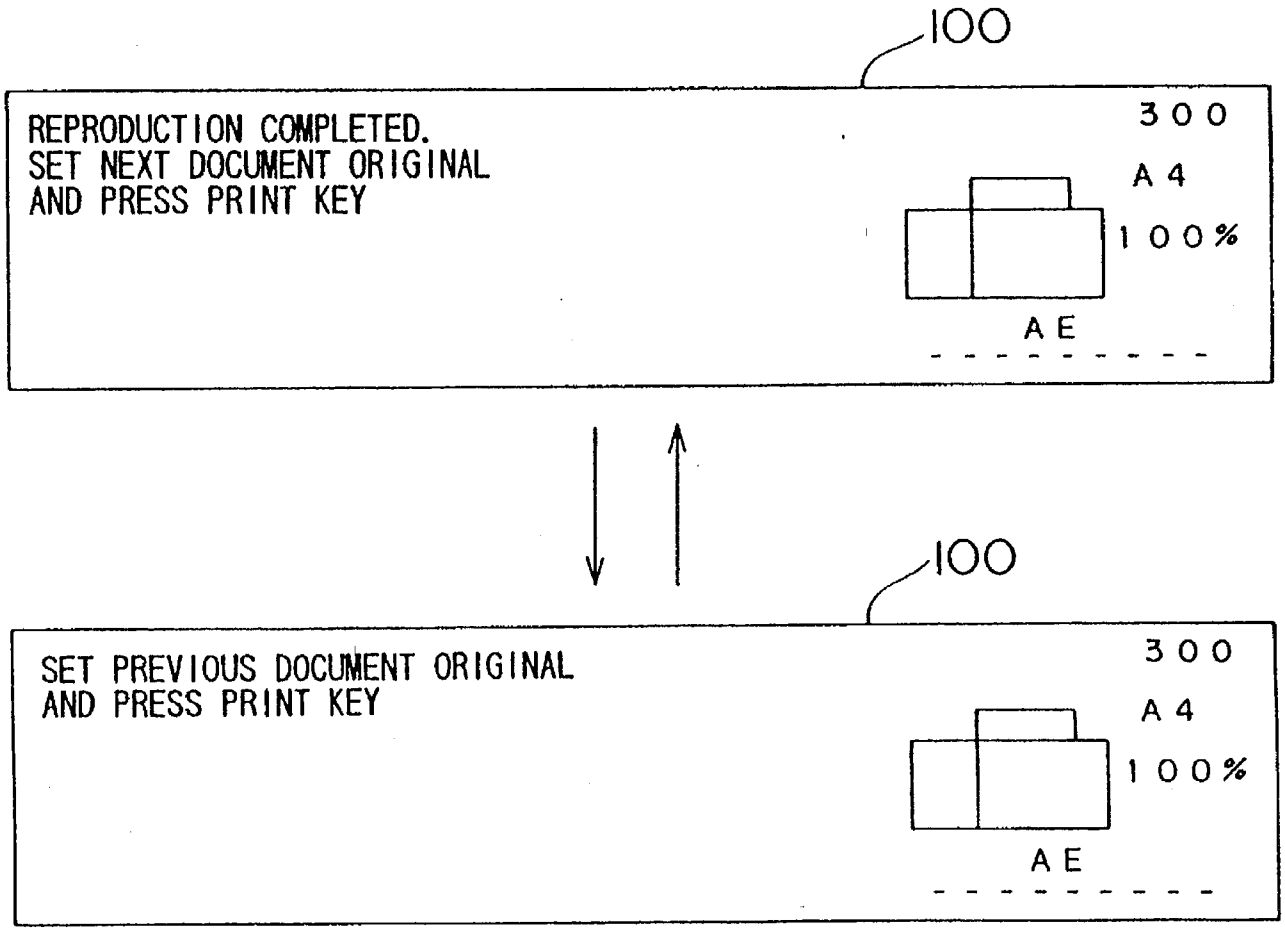
FIGS. 7A and 7B illustrate an example of presentation on a display for giving the operator directives in the one-side/two side copy mode.

How to give "directive of replacing a document original" will be described taking a case when there are two one-sided document originals by way of example. FIGS. 7A and 7B show presentations in the display 100 in the one-side/two-side copy mode. When 100 copies of the first one-sided document original is completed, the first document original must be removed from the image forming position J to produce 100 copies of the second document original. Accordingly, a message saying, "Reproduction completed. Set the next document original and press Print Key." is presented, as shown in FIG. 7A. The operator sets the second document original at the image forming position J and presses the print key 108 to start producing copies of the second document original. When the reproduction of the second document original is completed, copies of the first document original must be produced again, and therefore, a message saying, "Set the previous document original and press Print Key." is presented, as shown in FIG. 7B. The operator sets the first document original at the image forming position J and presses the print key 108 to start reproducing the first document original. With a directive of replacing a document original given for each 100 sheets, such operations may be repeated to produce desired copies. The operator simply needs to carry on the copying operation following directives presented in the display 100 and therefore, it is ensured that the operator will not make a mistake in the copying operation.

Figures 8A, 8B:
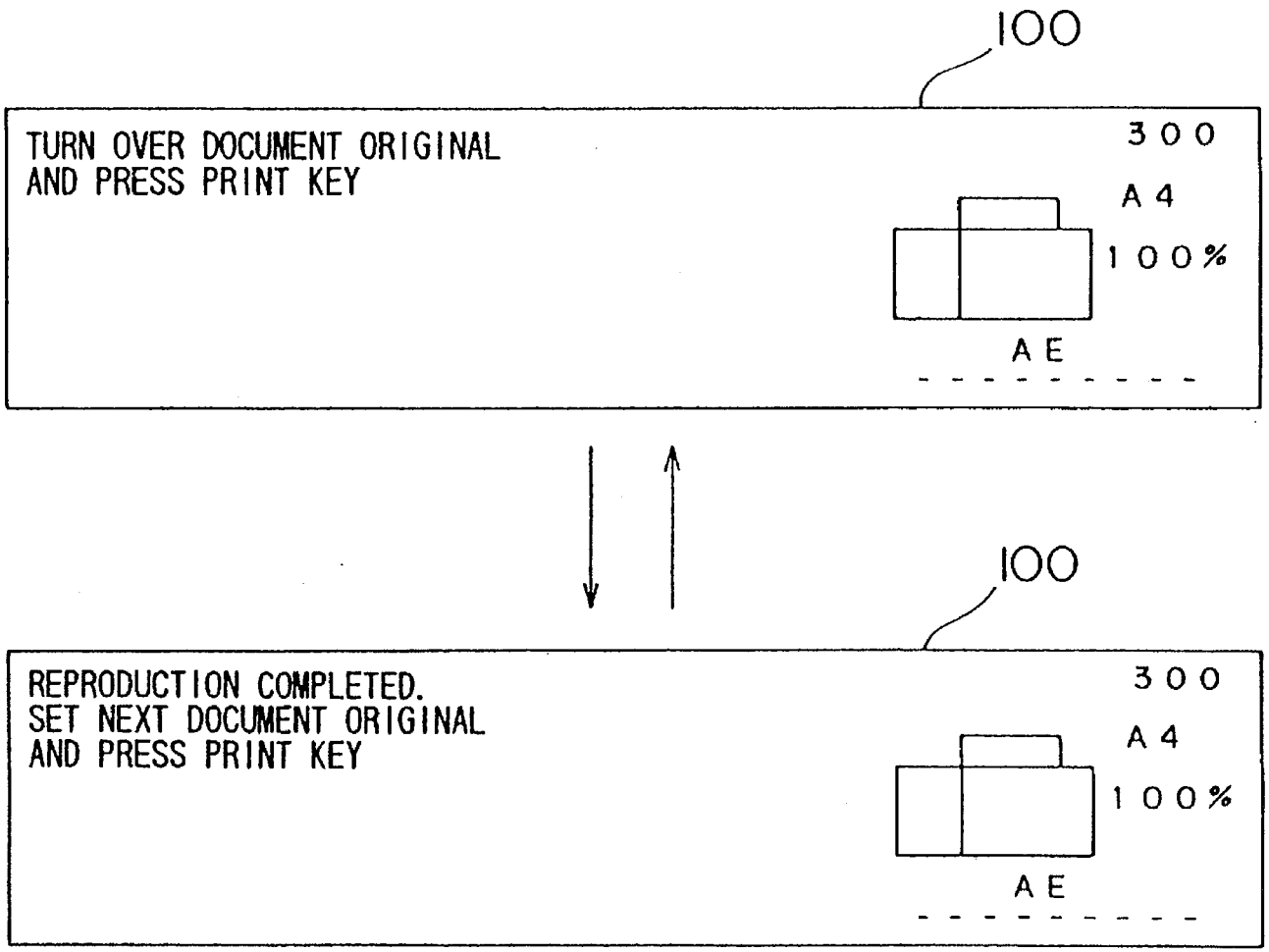
FIGS. 8A and 8B illustrate an example of presentation on the display for giving the operator directives in the two-side/two side copy mode.

Nextly, how to give "directives of replacing a document original" in the case of reproducing two-sided document originals. FIGS. 8A and 8B show presentations in the display 100 in the two-side/two-side copy mode. When 100 copies of the front side of a two-sided document original are produced, another 100 copies need be produced from the back side thereof. Accordingly, a message saying, "Turn over the document original and press Print Key." is presented in the display 100, as shown in FIG. 8A. The operator turns over the document original and presses the print key 108 to start reproducing the back side thereof. When the reproduction of the back side thereof is completed, copies of the front side thereof must be produced again and therefore, a message saying, "Turn over the document original and press Print Key." is presented as shown in FIG. 8A. Turning over the document original again, the operator sets it at the image forming position J and presses the print key 108 to start reproducing the front side thereof. When the reproduction of the front side thereof is completed, copies of the back side thereof need be produced again. With a directive of turning over a document original given for each 100 sheets, such operations may be repeated to produce desired copies. When a preset number of copies are produced, a message saying, "Reproduction completed. Set the next document original and press Print Key." is presented so that similar operations may be repeated with respect to the next document original. Thus, the operator simply needs to carry on the copying operation following directives presented in the display 100 and thus it is ensured that the operator will not make a mistake in a complicated copying operation for two-sided document originals.

Figure 9:
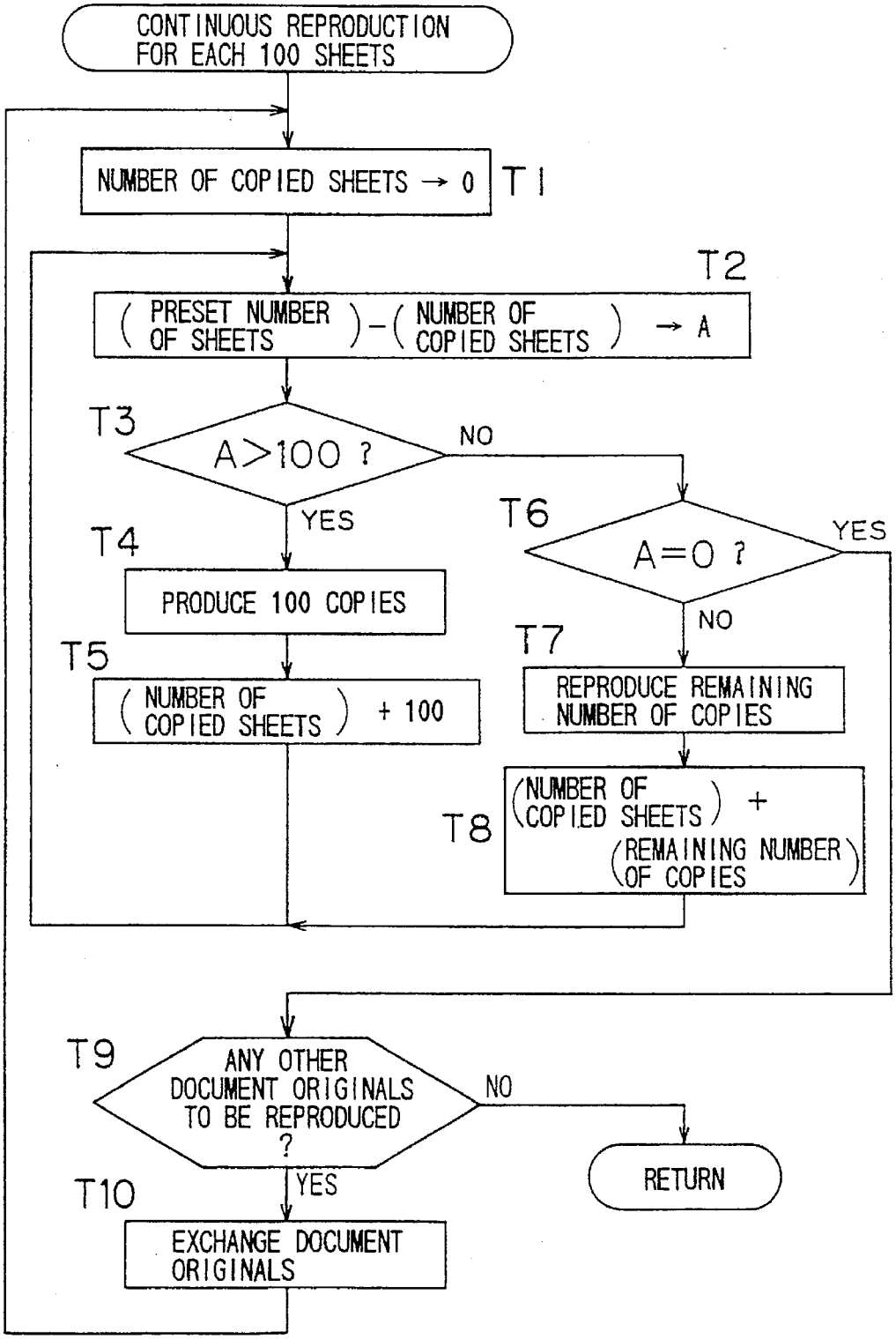
FIG. 9 is a flow chart for illustrating operations for "continuous reproduction for each unit number (100 sheets)"

With reference to the flow chart (FIG. 9), operations for "continuous reproduction for each 100 sheets" will be described. It is presumed that the screen (not shown) of the display 100 has a box for presenting the preset number of sheets and a box for presenting the number of copied sheets. The number of copied sheets is set to "0" in Step T1. A value A is given by subtracting "the number of copied sheets" from "the preset number of sheets" in Step T2. Naturally the value A is equivalent to the preset number of sheets. In Step T3, the value A is compared with 100 which represents the number of sheets to be stored by the intermediate tray 67. If A>100, 100 copies are first produced in Step T4. More specifically, in the two-side/two-side copy mode, there is repeated 100 times an operation wherein a copy sheet is taken from any one of the upper deck 53A and the like, an image of the front side of a document original is reproduced on the copy sheet thus taken, and the copied sheet is stored by the intermediate tray 67. In the subsequent step to reproduce the back side of the document original, the document original placed at the image forming position J is introduced into the reverse passage 35 to be reversed by means of the transport belt (roller) 26, the secondary sheet feeding roller 25 and the reverse roller 33 and is fed again to the image forming position J, while copied sheets held in the intermediate tray 67 are guided to the photoconductive drum 45 so that an image of the back side of the document original is reproduced thereon. In the one-side/two-side copy mode, the operations are different only in that a document original is not reversed but discharged instead so that the next document original is fed to the image forming position J.

Then in Step T5, 100 is added to the number of copied sheets and then the flow returns to Step T2 so that the operations from Step T2 to Step T5 are repeated until the value A becomes less than 100. If the value A becomes less than 100 in Step T3, whether the value A is 0 or not (i.e., whether the preset number of copies have been all produced or not) is judged in Step T6. If the value A is not 0, the remaining number of copies are produced in Step T7 to add "the remaining number of copies" to "the number of copied sheets" in Step T8, and the flow returns to Step T2. Then, the flow proceeds from Step T2 to Step T6 where judgment is made on whether the value A is 0 or not. If the value A is 0, it means that the preset number of copies of the document original have been produced, and the flow proceeds to Step T9 to judge whether there are any other document originals to be reproduced. If RDH 2 is used, such judgment is automatically made by the document original detection sensor S. However, if copies are produced from page(s) of a book placed in position by hand, there is required a manual operation for turning over a page and repositioning the book in place.

If there is another document original to be reproduced, document originals are exchanged (Step T10). The exchange of document originals includes a step of replacing document originals as well as a step of turning over two-sided document originals. With RDH 2, two-sided document originals can be turned over automatically. If copies are produced from page(s) of a book manually placed in position, the exchange of document originals is performed manually by turning over the page(s) and repositioning the book in place, as described above. Such a manual operation for replacing a document original requires a message presented in the display 100 saying, "Turn over a page."

After the replacement of a document original, a new document original or a document original thus turned over is subject to the operations of Step T1 and its subsequent steps.

If there is no document original to be reproduced, the operation flow is terminated.

As it is apparent from the foregoing description of the sequence of operations, the embodiment allows production of a number of copies exceeding the storing capacity of the intermediate tray 67 both in a two-side copy mode using RDH 2 and in a two-side copy mode with respect to manually fed document originals.

However, it should be appreciated that the present invention should not be limited to the foregoing embodiment. The aforementioned embodiment is arranged such that when reproducing manually fed document originals, copies are produced for each number of sheets which can be stored by the intermediate tray in Step S22 or S23 in FIG. 6. Alternatively, there may be an embodiment which is adapted to automatically restrict the number of copies of a manually fed document original to the number that the intermediate tray can store. In this case, repetition of reproduction for each predetermined number of sheets (e.g., 100) as in Step S22 or S23 in FIG. 6 is not required, but reproduction may be performed simply considering that a directive of producing a given number of copies is given. At this time, the display 100 preferably presents a message saying, "Reproduction in this mode is limited to 100 copies. To produce more than 100 copies, set the document original in RDH." If the production of copies of a manually fed document original is limited to a predetermined number in this way, the operator who wants to produce more copies than the predetermined number at a time will have to set the document original in RDH, whereby eliminating the need for the copying machine to provide for an interactive copying operation as shown in FIGS. 7A, 7B, 8A and 8B, and to be equipped with a program for responding to the operator in an interactive manner.

Additionally, there may be an embodiment arranged such that if a preset number of copies to be produced from a manually fed document original exceeds the storing capacity of the intermediate tray, the reproduction thereof is prohibited automatically. In this case, the display 100 preferably presents a message saying, "Production of more than 100 copies unavailable in this mode. To produce more than 100 copies, set the document original in RDH." Similarly in this case, the operator who wants to produce more copies than a predetermined number will have to set the document original in RDH, whereby eliminating the need for the copying machine to provide for an interactive copying operation as shown in FIGS. 7A, 7B, 8A and 8B, and to be equipped with a program for responding to the operator in an interactive manner.

What is claimed is:

1. An image forming apparatus for performing image forming operations for forming on a copy sheet an image of a document original fed to an image forming position, which comprises:

image forming mode specifying means for setting a two-sided image forming mode to effect the image forming operations on both sides of a copy sheet by the use of an intermediate tray;

sheet number setting means for setting the number of copy sheets to be subject to the image forming operations with respect to the same document original;

image forming operation repeating means for performing the image forming operations for each of a predetermined number of copy sheets when it is determined, in the two-sided image forming mode as set by the image forming mode specifying means, that the number of copy sheets set by the sheet number setting means exceeds the storing capacity of the intermediate tray; and document original replacement directive means for giving an operator a required directive of replacing a document original when the image forming operations are effected by the image forming operation repeating means.

2. An image forming apparatus as claimed in claim 1, further comprising cancel means for canceling image forming operations for forming images on both sides of a copy sheet as effected by the image forming mode specifying means when there in one document original to be reproduced in a mode effected by the image forming mode specifying means wherein images of one-sided document original are to be formed on both sides of a copy sheet.

3. An image forming apparatus which includes automatic document original feeding means for automatically individually feeding one or more document originals to an image forming position and for refeeding the document originals thus fed to the image forming position and which performs image forming operations for forming on a copy sheet an image of a document original fed by the automatic document original feeding means to the image forming position, comprising:

image forming mode specifying means for setting a two-sided image forming mode to effect the image forming operations on both sides of a copy sheet by the use of an intermediate tray, sheet number setting means for setting the number of copy sheets to be subject to the image forming operations with respect to the same document original, and image forming operation repeating means for performing the image forming operations for each predetermined number of copy sheets when it is determined, in the two-side image forming mode as set by the image forming mode specifying means, that the number of copy sheets set by the sheet number setting means exceeds a storing capacity of the intermediate tray, such that the image forming apparatus is capable of forming on a copy sheet both an image of a document original fed to the image forming position by the automatic document original feeding means and an image of a document original fed directly to the image forming position not by the automatic document original feeding means, and wherein the image forming apparatus further comprises sheet number limiting means for limiting the number of copy sheets to be set by the sheet number setting means to the storing capacity of the intermediate tray when an image of a document original fed directly to the image forming position not by the automatic document original feeding means is formed on the number of copy sheets set by the sheet number setting means, which number is determined to be larger than the storing capacity of the intermediate tray.

4. An image forming apparatus which includes automatic document original feeding means for automatically individually feeding one or more document originals to an image forming position and for refeeding the document originals thus fed to the image forming position and which performs image forming operations for forming on a copy sheet an image of a document original fed by the automatic document original feeding means to the image forming position, comprising:

image forming mode specifying means for setting a two-sided image forming mode to effect the image forming operations on both sides of a copy sheet by the use of an intermediate tray, sheet number setting means for setting the number of copy sheets to be subject to the image forming operations with respect to the same document original, and image forming operation repeating means for performing the image forming operations for each predetermined number of copy sheets when it is determined, in the two-side image forming mode as set by the image forming mode specifying means, that the number of copy sheets set by the sheet number setting means exceeds a storing capacity of the intermediate tray, such that the image forming apparatus is capable of forming on a copy sheet both an image of a document original fed to the image forming position by the automatic document original feeding means and an image of a document original fed directly to the image forming position not by the automatic document original feeding means, and wherein the image forming apparatus further comprises prohibition means for prohibiting the forming of an image of a document original fed directly to the image forming position not by the automatic document original feeding means when it is determined that the number of copy sheets set by the sheet number setting means exceeds the storing capacity of the intermediate tray.

* * * * *